United States Patent [19]

McKillip

[11] Patent Number: 4,664,031

[45] Date of Patent: May 12, 1987

[54] STENCIL APPARATUS AND METHOD FOR FORMING AND AFFIXING SAME

[75] Inventor: John J. McKillip, Naperville, Ill.

[73] Assignee: American Stencil, Inc., Chicago, Ill.

[21] Appl. No.: 729,739

[22] Filed: May 2, 1985

[51] Int. Cl.[4] ..... B41N 1/24

[52] U.S. Cl. ..... 101/127.1; 101/128.1

[58] Field of Search ..... 101/125, 127, 128.2, 101/128.4, 127.1, 128.1

[56] References Cited

U.S. PATENT DOCUMENTS

| | | | |
|---|---|---|---|
| 2,976,802 | 3/1961 | Mason | 101/128.1 |
| 3,094,342 | 6/1963 | Weber | 101/128.1 |
| 3,162,116 | 12/1964 | Weber | 101/128.1 |
| 3,280,732 | 10/1966 | Mooney et al. | 101/128.1 |
| 3,457,856 | 7/1969 | Rydberg et al. | 101/128.21 |
| 3,786,748 | 1/1974 | Rabelow | 101/128.1 |
| 3,788,217 | 1/1974 | Rabelow | 101/128.1 |
| 3,789,756 | 2/1974 | Weber | 101/128.2 |
| 3,926,113 | 12/1975 | Steidinger | 101/127 |
| 4,184,428 | 1/1980 | Hosoya | 101/125 |
| 4,226,209 | 10/1980 | Kenworthy | 101/125 |

*Primary Examiner*—Edgar S. Burr
*Assistant Examiner*—David A. Wiecking
*Attorney, Agent, or Firm*—Dick and Harris

[57] ABSTRACT

A stencil apparatus for removable and stabilized affixation to the upper surface of a business form for subsequent removal, in a facilitated manner, to enable reproduction of indicia on other surfaces such as shipping containers. A thin planar ply of stencil material is operably bonded to a frame member attached along the material's bottom peripheral surface. The frame member is, in turn, removably affixed to the upper surface of the business form by adhesive in the form of spherical globules. A method for forming and affixing the stencil apparatus to the business form is described in which continuous webs of stencil and frame material are preliminarily formed for subsequent yet removable bonding of individual stencil assemblies to the business form.

10 Claims, 7 Drawing Figures

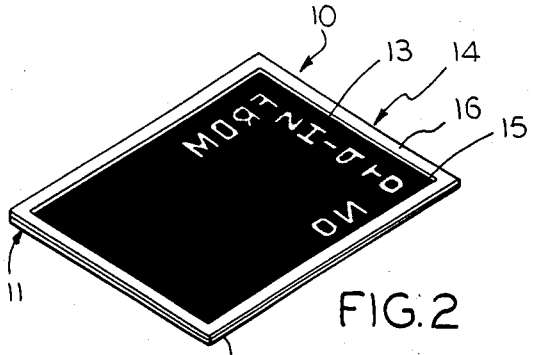
FIG. 2
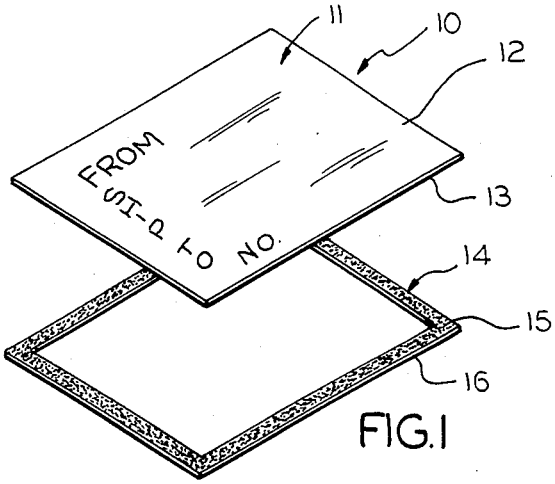
FIG. 1
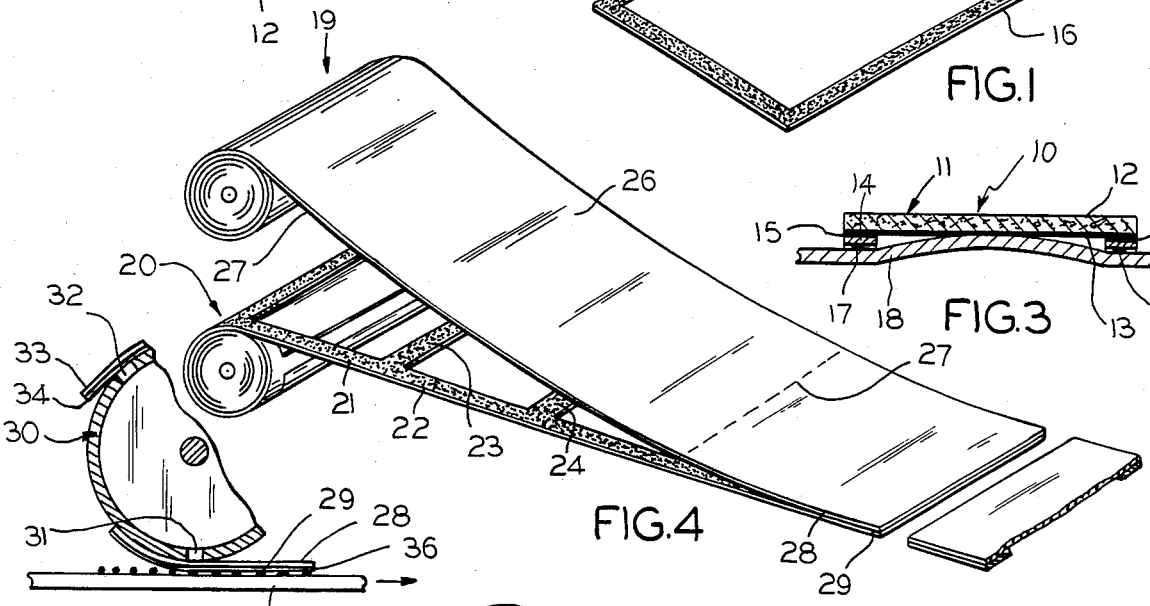
FIG. 4
FIG. 3
FIG. 5
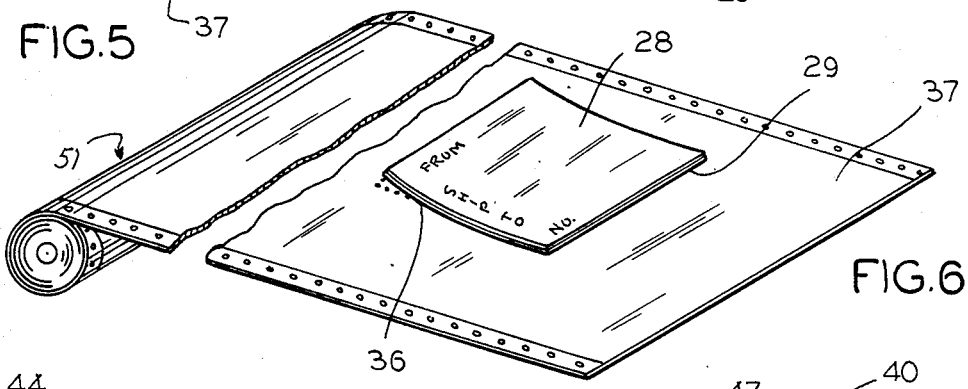
FIG. 6
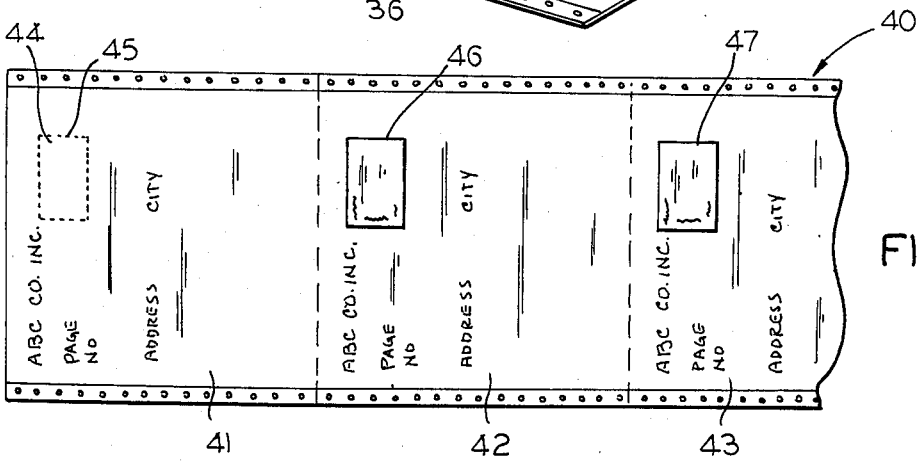
FIG. 7

STENCIL APPARATUS AND METHOD FOR FORMING AND AFFIXING SAME

BACKGROUND OF THE INVENTION

The present invention relates in general to indicia transfer apparatus and in particular to a stencil apparatus for stabilized yet removable affixation to the surface of a business form, as well as to a method for forming and affixing said stencil apparatus to such business forms.

While various stencil apparata have been utilized over the years in association with business forms most such stencil forms have comprised either a single flat sheet of stencil material or a single flat sheet of stencil material bonded to an upper frame, along the top of the stencil material, in an environment in which the frame adds stiffness to the stencil to prevent folding over, hanging up, etc.

In either of the two above-described prior art embodiments, however, drawbacks have been encountered with these conventional constructions. In particular, a "non-framed" or "top framed" stencil apparatus can present problems out of their manner of affixation to the business form while permitting relatively facilitated removal of the stencil when desired. By example, such prior art stencils have possessed and/or have promoted "flapping" of one or more of the edges of the stencil as the business form bearing the stencil is being processed, printed or utilized in either a computer or typewriter, thereby causing the stencil to either be "hung up" or ripped off the business form inadvertently.

Additionally with such prior art stencil assemblies the adhesive means through which the stencil was maintained in affixation to the upper surface to the business form would, on occasion, inadvertently cause the relatively fragile stencil material regions to stick to the business form, especially when the stencil, in its entirety, was removed thereby causing a separation, rip, tear or outright destruction of the stencil assembly at the time of desired removal.

Alternatively, such conventional stencil assemblies often involved discoloration of the business form made evident to the user upon removal of the stencil itself—arising out of the bonding adhesive coming into fluid contact with the carbon impregnated lower surface of the stencil material itself.

One such prior art frame stencil assembly is disclosed in U.S. Pat. No. 3,926,113 describing a stencil assembly with a thin upper frame portion which, through undercutting, has attached thereto, at its bottom surface, the conventional stencil and carbon plys.

It is thus an object of the present invention to provide an improved stencil assembly which is more fixedly and restrainably attachable to the upper surface of a business form while enabling detachable removal of the entire stencil assembly in a facilitated manner.

It is additionally an object of the present invention to provide such a stencil apparatus which through segregation of adhesive and frame, precludes carbon discoloration of a business form as well as the potential for smearing and obliteration that could accompany same.

As a further object of the present invention, is provision of an improved removable stencil apparatus which is affixable to a business form in a manner which guards against the inadvertent "flapping" of any of the edges of the stencil assembly and which further prevents the inadvertent removal, hangup or outright destruction, through tearing, of the stencil assembly during further processing of the business form bearing the stencil itself.

As an additional object of the invention, is the provision of such a stencil assembly which actually promotes the clean, complete, facilitated separation of the stencil assembly from the business form leaving absolutely no evidence of carbon particle migration or discoloration—in an environment in which the stencil assembly itself is formed and affixed to the business form through a series of high speed continuous formation processes at substantially reduced cost and effort.

These and other objects of the invention will become apparent in light of the present specification, drawings and claims.

SUMMARY OF THE INVENTION

The present invention comprises a stencil apparatus for removable yet stabilized affixation to the upper surface of a business form in which the stencil apparatus is of the type possessing means to accept the impression of indicia, as desired, to in turn be removed from the business form in a facilitated manner towards recreating the impressed indicia borne by the stencil itself onto other surfaces, such as those of shipping containers and the like.

This stencil apparatus comprises a substantially thin planar ply of stencil material having a top surface and a bottom surface. The stencil material ply is formed of a substantially plasticized deformable material capable of yielding to accept the indicia impressions towards reproduction of these impressions on such other surfaces through the application of a fluid medium along the top surface of the impressed stencil material ply, in an environment where the fluid medium is capable of passing through the formed impressions to reproduce the indicia on these other surfaces.

The stencil apparatus further comprises a substantially flexible thin planar frame means having an upper surface and a lower surface. The upper surface of the frame means is operably aligned with and attached to a marginal portion of the periphery of the stencil material ply in juxtaposition to the bottom surface of the stencil material ply. Additionally, the upper surface of the planar frame means is attached to the lower surface of the stencil material ply by stencil frame attachment means operably disposed therebetween the two. Furthermore, the bottom surface of the substantially flexible thin planar frame means is removably affixed to the upper surface of the business form in a position substantially juxtaposing the lower surface of the stencil material ply to a desired location along the upper surface of the business form—said affixation being accomplished through frame form attachment means.

In the preferred embodiment of the invention, the stencil apparatus further includes a thin, substantially planar layer of carbon material ply integrated into the bottom surface of the stencil material ply to enable the simultaneous reproduction of the indicia upon impression thereof, both in the stencil itself as well as atop the upper surface of the business form. The reproduction of the indicia enabled by the utilization of the carbon ply further enables identification of the indicia impressed into the stencil upon the surface of the business form, even after removal of the stencil apparatus from that business form.

The stencil apparatus is substantially rectangular in shape with the flexible thin planar frame means framing all four peripheral sides of the substantially rectangular apparatus along the marginal portion of each respective side thereof. This marginal portion for each respective peripheral side of the stencil apparatus, and particularly relative to the stencil material ply aligned with and juxtaposed to the flexible thin planar frame means, falls into the region of from 0.07 to 0.085 the overall dimensional size of the stencil material ply being so marginally framed along the lower surface of same.

Preferrably, the stencil frame attachment means comprises a pressure sensitive adhesive layer of material operably positioned between the lower surface of the stencil material ply and the upper surface of the frame. This pressure sensitive adhesive layer of material embodying the stencil frame attachment means is continuously extensive over the entire juxtaposed region between the lower surface of the stencil material ply and the upper surface of the frame. Furthermore, the pressure sensitive adhesive material is preliminarily formed, prior to its interpositioning between the stencil material ply and the frame means, as an integrated layer atop the frame means adjacent the upper surface of same.

The frame form attachment means, on the other hand, comprises a plurality of substantially spherical adhesive globules preliminarily positioned between the upper surface of the business form and the lower surface of the frame means. Each of the plurality of adhesive globules is deformable upon the assertion of compressive pressure simultaneously applied upon the apparatus and the globules to spread and grip the frame means to the business form in a bonded fashion until this bond is broken by the manual lifting of the entire stencil apparatus from its position atop the upper surface of the business form. Furthermore, the adhesive globules are of such a size, orientation and placement along the lower surface of the frame means so as to preclude, upon deformation and contact with the lower surface of the frame means, globule over-enlargement and inadvertent contact with any portions of the lower surface of the stencil material ply so as to prompt complete segretation therefrom. Isolation of the compressed deformed globules from the stencil material ply and particularly the carbon element integrated into the bottom of the stencil material ply assures "clean" removal of the stencil along the frame means, when desired, while avoiding any contact of liquid elements of the adhesive with the carbon portion to avoid either sticking of the stencil ply or carbon, or migration of carbon discoloration from the stencil ply onto the top surface of the business form. To this purpose additionally, the frame form attachment globules are preferably formed of a substantially latex rubber adhesive cement.

The stencil material ply comprises a substantially thin planar sheet of plasticized material in which displacement of the plasticized material occurs upon the impressing of said indicia into same so as to form substantially apertured impression regions through which the previously mentioned fluid medium may flow to, in turn, recreate the indicia upon other surfaces. In this embodiment the stencil material ply includes preliminarily impressed indicia prior to the attachment of the stencil to the business form, as well as before the acceptance of additional indicia impressions thereupon. This preliminarily placed indicia comprises standardized information headings proximate to which the additional indicia impressions may be placed by a user of the stencil apparatus.

The present invention further comprises a method for forming and removably affixing a stencil apparatus to a business form, the stencil apparatus being of the type capable of accepting impressions of indicia for subsequent removable towards recreation of the impressed indicia on other surfaces. This method for forming and affixing the stencil apparatus comprises the steps of (a) preliminarily forming a single web of a plurality of joined stencil assemblies by bonding, through adhesion means, a substantially continuous lower web of aperture frame members to an aligned continuous upper web of stencil material ply. This single web of joined stencil assembly is then (b) severed, on a continuous basis, to form a plurality of individual unattached stencil assemblies which are (c) transferred, one by one, and on a continuous basis, to continuous applicator means positioned in operable alignment with a substantially continous web of joined business forms. A plurality of adhesive globules are (d) preliminarily deposited upon the upper surface of each business form in the continuous web of joined business forms, at a stencil attachment region in alignment with the desired position for acceptance of one of the individual stencil assemblies thereupon.

The lower surface of the respective frame member of one of the individual stencil assemblies is (e) continuously applied at a position atop the deposited adhesive globules for aligned contact therebetween. The individual stencil assembly is then (f) bonded to one of each of the respective business forms by compressing the assembly along the respective lower surface of the frame means, together with the plurality of adhesive globules and the upper surface of the business form, for removable affixation therebetween. Through such a series of steps a finished business form which may be severed at will, or retained attached in web form to the remaining series of business forms, is operably created with each business form among the plurality of business forms possessing its own accurately positioned removably affixed stencil apparatus for further application of impressed indicia and, in turn, removal towards recreation of the impressed indicia upon such other surfaces as described hereinabove.

BRIEF DESCRIPTION OF THE DRAWINGS

FIG. 1 of the drawings is a top perspective exploded view of Applicant's present stencil apparatus particularly showing positioning of the stencil ply material atop the substantially aligned flexible thin planar frame means;

FIG. 2 is a bottom perspective view of the stencil apparatus of FIG. 1 showing particularly the lower position of the flexible frame means, the lower surface of the substantially thin planar ply of stencil material together with its integrated carbon ply thereupon as well as premarked indicia impressions marked therein;

FIG. 3 is an elevated cross-sectional view of the stencil apparatus of FIG. 1 in position atop the upper surface of a business form;

FIG. 4 is a perspective view showing, schematically, formation of a single web of joined stencil assembly through the preliminary bonding of a substantially continuous lower web of apertured frame material to an aligned continuous upper web of stencil material ply positioned thereover;

FIG. 5 is an elevated side view of the continuous applicator means for feeding, through vacuum suction, individual ones of the formed and severed stencil assemblies to the top of a web of continuous business forms;

FIG. 6 is a top perspective view showing one of Applicant's stencil assemblies in position atop the upper surface of a business form; and, FIG. 7 is a top plan view of a continuous web of a plurality of business forms showing, positioned thereupon each, one of Applicant's individual stencil assemblies, as well as a pattern of adhesive globules for maintaining a stencil assembly in removable yet stable attachment thereupon each said business form.

DETAILED DESCRIPTION OF THE DRAWINGS

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

FIG. 1 of the drawings shows stencil assembly 10 having substantially thin planar stencil ply 11 with upper surface 12 and lower surface 13 in position, atop aligned substantially flexible thin planar frame means 14 having upper surface 15 comprising a pressure sensitive adhesive material, and nonadhesive lower surface 16. As shown in FIGS. 1 and 2, the preferred embodiment of the invention includes preformed indicia impressions such as the standardized informational headings "From", "Shipped To", and "No." already preliminarily formed in the stencil so that additional corresponding information need merely be placed in the stencil through other indicia impressions. As previously described, the ply of stencil material comprises a substantial plasticized material capable of permitting plasticized displacement of the stencil material to accordingly form apertured impression regions upon direct impression thereupon through typing, writing, etc., to in turn permit "stencilling" through application of a fluid medium thereover.

As shown in FIG. 2, lower surface 13 of stencil assembly 10 includes a layer or ply of carbon material integrated within lower surface 13, so as to enable reproduction of the indicia impressions formed therein the label, along the upper surface of the associated business form. Also shown in FIG. 2 are upper surface 12 of stencil ply 11 and lower surface 16 of frame member 14.

Stencil assembly 11 is also shown in FIG. 3 with upper surface 12, lower surface 13 which includes the above-mentioned integrated carbon material for reproducing the indicia directly on to the upper surface of business form 18, as well as adhesive material 15 preliminarily and continuously bonded to frame means 14, for the purpose of restrainably attaching the lower surface 13 of stencil ply material 11 to the upper surface of frame member 14. In the preferred embodiment of the invention this adhesive material 15 is substantially coextensive with the entire juxtaposed surface between frame member 14 and the lower surface of stencil ply material 13 and, moreover, comprises a substantially preliminarily formed, pressure sensitive adhesive along the upper surface of the frame material, thereby forming the stencil frame attachment means therebetween the upper surface of frame 14 and lower surface of stencil ply 11. Additionally shown in FIG. 3 are frame form attachment means 17 interposed between the bottom surface of the planar frame means 14, to permit removable affixation of the overall stencil assembly 10 to the upper surface of business form 18. In the preferred embodiment, the frame form attachment means comprises a plurality or series of spherical glue globules arranged in a geometric pattern corresponding to the shape of frame member 14 for direct attachment of the frame to the business form. The globules are of such a size and placement as to preclude the inadvertent spreading, upon compression, into contact with the exposed inner regions of carbon surface along the lower unframed portions of stencil material ply 11. Additionally the frame form attachment means comprises a substantially latex rubber cement having substantial free-flow application characteristics through a glue applicator, while at the same time being relatively easy to detach from between the lower surface of the frame member and the business form—for removal of the stencil apparatus.

A schematic view of the method through which a single web of formed joined stencil assemblies is created is shown in FIG. 4 in which a substantially continuous web of apertured frame members 20 having frame member portions 21 thru 24 (covered with adhesive) described thereon for preliminary bonding to upper web 19 of stencil material ply 26. After bonding therebetween these two continuous webs, they are severed at an appropriate position, such as severence region 27, to form individual ones of the stencil assemblies.

Continuous applicator means 30 of FIG. 5 utilizes suction through gripping apertures 31 and 32 to maintain individual stencil assemblies 33-34 and 28-29 in place, for transferral to an operably aligned continuous web of business forms 37 positioned therebelow applicator 30. Stencil assembly 33-34 includes frame member 33 and stencil material ply 34 while stencil assembly 28-29 includes stencil material ply 28 and frame member 29, for positioning and attachment over business form 37. Substantially spherical adhesive globules 36, as previously mentioned, are arranged in a substantially aligned fashion with the position and shape of frame member 29 so as to enable attachment of said frame, and only said frame, to the upper surface of business form 37, upon positioning of the frame member portion thereover; as well as upon application of pressure to substantially spread, upon compression, the shape of the globules as shown in FIG. 5. This bonding compression is exerted by applicator 30—as business form web 37 moves in the direction indicated by the arrow while applicator cylinder 30 turns counterclockwise.

Business form web 51 and particular business form 37 is shown in FIG. 6 as comprising a computer generated document capable of being fed in the direction of the arrow of FIG. 5, through sprocket attachment means located on the sides thereof. Individual stencil assembly 28-29 including stencil material ply 28 with frame member 29 positioned thereunder, are shown in partial attachment in said FIG. 6, through the frame form attachment means globules 36, partially shown therebelow.

A series of continuously fed business forms bearing desired individual stencil assemblies is shown in FIG. 7 in which continuous web 40 includes business forms 41 through 43. Forms 42 and 43 include applied stencil assemblies 46 and 47 respectively, while business form 41 is shown schematically possessing applicator region 44 with preliminarily deposited adhesive globules positioned thereabout for acceptance of an equivalent frame member portion of an individual stencil assembly for attachment therebetween.

As shown in FIGS. 1 thru 7, the preferred embodiment of the invention contemplates the utilization of a rectangularly shaped frame in which the outer peripheral surfaces of the stencil material ply and the frame member are substantially aligned and juxtaposed, with the ratio of frame material to planar stencil size, in a given dimension, falling in the range of 0.07 to 0.085 percent the size of that particular respective dimension.

The foregoing description and drawings merely explain and illustrate the invention and the invention is not limited thereto except insofar as the amended claims are so limited, as those skilled in the art who have the disclosure before them will be able to make modifications and variations therein without departing from the scope of the invention.

What is claimed is:

1. A stencil apparatus for removable yet stablized affixation to the upper surface of a business form, said stencil apparatus of the type possessing means to accept the impression of indicia as desired to transfer said indicia to said business form and to, in turn, be removed, in a facilitated manner, from said business form to enable reproduction of said impressed indicia on other surfaces such as those of shipping containers, said stencil apparatus comprising:

a substantially thin planar ply of stencil material having a top surface and a bottom surface;

said stencil material ply being deformable to yield to accept said indicia impression to enable said reproduction of said impression on said other surfaces through application of a fluid medium along the top surface of said stencil material ply, with said fluid medium passing through said impression to reproduce said indicia on said other surfaces;

a thin substantially planar layer of carbon ply integrated into the bottom surface of said stencil material ply to enable the simultaneous imprinting of said indicia atop the upper surface of said business form and, the deformation of said stencil material ply upon the impression thereof, said reproduction of said indicia being manifested by said carbon ply at said desired location along the upper surface of said business form so as to enable identification of said indicia thereupon the surface of said business form after removal of said stencil apparatus therefrom;

substantially flexible continuous, uninterrupted thin planar frame means having an upper surface and a lower surface;

said frame means having an unobstructed aperture of such size and shape to permit the bottom surface of said stencil material ply to contact the upper surface of said business form in an unobstructed manner to thereby permit the transfer of said indicia directly upon said business form, the upper surface of said planar frame means being operably aligned with and attached to a marginal portion of the periphery of said stencil material ply, in juxtaposition to the bottom surface of said stencil material ply, the upper surface of said planar frame means further being attached to the lower surface of said stencil material ply by stencil frame attachment means operably disposed therebetween, the outer peripheral edges of said planar frame means being further laterally aligned with the respective outer peripheral edges of said stencil material ply, said bottom surface of said substantially flexible thin planar frame means being in removable affixation to the upper surface of said business form in a position substantially juxtaposing the lower surface of said stencil material ply to a desired location along said upper surface of said business form, in which the outer peripheral edges of said planar frame means are in said lateral alignment with said respective outer peripheral edges of said stencil material ply, through frame form attachment means operably interposed wholly therebetween.

2. The invention according to claim 1 in which said stencil apparatus is substantially rectangular in shape with said flexible thin planar frame means framing all four peripheral sides of said substantially rectangular apparatus along the marginal portion of each respective side thereof.

3. The invention according to claim 2 in which said marginal portion of each respective peripheral side of said stencil material ply aligned with and juxtaposed to said flexible thin planar frame means, falls in the range of from 7 to 8.5 percent of the overall dimensional size of the stencil material ply being so marginally framed along the lower surface of same.

4. The invention according to claim 1 in which said stencil frame attachment means comprises a pressure sensitive adhesive layer of material operably positioned between the lower surface of said stencil material ply and the upper surface of said frame means.

5. The invention according to claim 4 in which said pressure sensitive adhesive layer of material embodying said stencil frame attachment means is continuously coextensive over the entire juxtaposed region between said lower surface of said stencil material ply and the upper surface of said frame means, said pressure sensitive adhesive layer of material being preliminarily formed, prior to interpositioning between said stencil material ply and said frame means, as an integrated layer of said frame means adjacent said upper surface of same.

6. The invention according to claim 1 in which said frame form attachment means comprise a plurality of substantially spherical adhesive globules preliminarily positioned between the upper surface of said business form and the lower surface of said frame means;

each of said plurality of adhesive globules being deformable upon the assertion of compressive pressure simultaneously applied thereupon said apparatus and globules to spread and grip in a removable bonding fashion, until said bond is broken by the manual lifting of the entire stencil apparatus from its position atop the upper surface of said business form, said adhesive globules of such a size, orientation and placement along the lower surface of said frame means so as to preclude, upon deformation, enlargement and inadvertent contact with any portions of the lower surface of said stencil material ply to, in turn, prevent the defacing of said business form and prompt complete segregation therefrom.

7. The invention according to claim 6 in which said frame form attachment means comprises a plurality of said spherical adhesive globules formed of a substantially latex rubber adhesive cement.

8. The invention according to claim 1 in which said stencil material ply includes preliminarily impressed indicia prior to attachment of same to said business form as well as before the acceptance thereupon of said indicia impressions, said preliminarily placed indicia comprising standardized informational requirement headings proximate to which said indicia impressions are to be placed by a user of said stencil apparatus.

9. The invention according to claim 1 in which said stencil material ply comprises a substantially thin planar sheet of plasticized material in which displacement of said plasticized material occurs upon said impressing of said indicia into same so as to form substantially apertured impression regions through which said fluid medium may flow to in turn recreate said indicia on said other surfaces.

10. A method for forming and removably affixing a stencil apparatus for a business form, said stencil apparatus of the type capable of accepting impressions of indicia for subsequent removal to enable reproduction of said indicia on other surfaces, said method for forming and affixing said stencil apparatus comprising the steps of:

(a) preliminarily forming a single web of a plurality of joined stencil assemblies by bonding, through adhesion means, a substantially continuous lower web of apertured frame members to an aligned continuous upper web of stencil material ply in which said adhesion means are wholly positioned between said apertured frame members and said stencil material ply;

(b) severing, on a continuous basis, stencil assemblies from said single web of joined stencil assemblies to form a plurality of individual unattached stencil assemblies in which the outer peripheral edges of said apertured frame members are laterally aligned with the respective outer peripheral edges of said stencil material ply;

(c) transferring said individual stencil assemblies, on a continuous basis, to continuous applicator means positioned in operable alignment with a substantially continuous web of joined business forms;

(d) preliminarily depositing a plurality of adhesive globules on the upper surface of each of said business form in said continuous web of joined business forms at a stencil attachment region in alignment with the desired position for acceptance of one of said individual stencil assemblies thereupon;

(e) continuously aligning and applying the lower surface of the respective frame member of one of said individual stencil assemblies at a position atop the deposited adhesive globules for aligned contact therebetween; and (f) bonding the lower surface of each said respective frame member of said individual stencil assembly to each said respective business form by compressing said assembly along the respective lower surface of said frame means, together with said plurality of adhesive globules and the upper surface of said business form, for removable affixation therebetween.

* * * * *